US008973664B2

(12) United States Patent
Yates et al.

(10) Patent No.: US 8,973,664 B2
(45) Date of Patent: Mar. 10, 2015

(54) SUBSEA WELLHEAD STABILIZATION USING CYLINDRICAL SOCKETS

(71) Applicant: Vetco Gray Inc., Houston, TX (US)

(72) Inventors: Chad Eric Yates, Houston, TX (US); Philip John Potter, Houston, TX (US)

(73) Assignee: Vetco Gray Inc., Houston, TX (US)

( * ) Notice: Subject to any disclaimer, the term of this patent is extended or adjusted under 35 U.S.C. 154(b) by 126 days.

(21) Appl. No.: 13/659,380

(22) Filed: Oct. 24, 2012

(65) Prior Publication Data

US 2014/0110125 A1 Apr. 24, 2014

(51) Int. Cl.

| | |
|---|---|
| ***E21B 33/038*** | (2006.01) |
| ***E21B 33/035*** | (2006.01) |
| ***E21B 7/128*** | (2006.01) |
| ***E21B 43/08*** | (2006.01) |

(52) U.S. Cl.

USPC ..... 166/344; 166/341; 166/360; 166/368; 166/378

(58) Field of Classification Search

CPC ..... E21B 19/16; E21B 33/035; E21B 33/038; E21B 33/03; E21B 33/04; E21B 33/043; E21B 34/04; E21B 23/00; E21B 23/01; E21B 43/10; E21B 33/05; E21B 33/076; E21B 33/12; E21B 33/1208; E21B 33/13

USPC ..... 166/338, 341, 344, 348, 360, 368, 378, 166/379, 380; 285/123.1, 123.3

See application file for complete search history.

(56) References Cited

U.S. PATENT DOCUMENTS 3,188,118 A * 6/1965 Jones ..... 285/123.3
3,486,556 A * 12/1969 Burgess ..... 166/338
4,355,825 A * 10/1982 Leicht ..... 285/3
4,472,081 A * 9/1984 Lawson ..... 405/169
4,474,236 A * 10/1984 Kellett ..... 166/250.08
4,736,799 A * 4/1988 Ahlstone ..... 166/348
4,742,874 A * 5/1988 Gullion ..... 166/348
4,751,968 A * 6/1988 Ames et al. ..... 166/368
4,938,289 A * 7/1990 Van Bilderbeek ..... 166/342
5,002,129 A * 3/1991 Hopper ..... 166/338
5,029,647 A * 7/1991 Milberger et al. ..... 166/367
5,066,048 A * 11/1991 Farrell ..... 285/18
5,069,288 A * 12/1991 Singeetham ..... 166/348
5,088,556 A * 2/1992 Short et al. ..... 166/339
5,240,081 A 8/1993 Milberger et al.
5,247,996 A * 9/1993 Milberger ..... 166/348
5,299,643 A * 4/1994 Vetter et al. ..... 166/368
5,366,017 A * 11/1994 Voss, Jr. ..... 166/368
5,544,707 A * 8/1996 Hopper et al. ..... 166/382
5,662,169 A * 9/1997 Hosie ..... 166/344

(Continued)

*Primary Examiner* — Matthew Buck
*Assistant Examiner* — Edwin Toledo-Duran
(74) *Attorney, Agent, or Firm* — Bracewell & Giuliani LLP

(57) ABSTRACT

A wellhead assembly for use subsea includes a high pressure housing landed within a low pressure housing. The low pressure housing is an annular member that mounts into the sea floor and having an inner surface engaging the high pressure housing along a loading interface. Upper and lower sockets are formed along axially spaced apart portions of the outer surface of the high pressure housing. As the high pressure housing inserts into the low pressure housing, the high pressure housing sockets engage corresponding sockets formed along axially spaced apart sockets on portions of the inner surface of the low pressure housing. The sockets each have cylindrically shaped outer surfaces, and when engaged with one another define the loading interface. The sockets are strategically located on the upper and lower portions of the housings to maximize their distance apart.

10 Claims, 3 Drawing Sheets

(56) References Cited

U.S. PATENT DOCUMENTS

| | | | | |
|---|---|---|---|---|
| 5,868,204 | A * | 2/1999 | Pritchett et al. | 166/368 |
| 6,234,252 | B1 * | 5/2001 | Pallini et al. | 166/345 |
| 6,360,822 | B1 * | 3/2002 | Robertson | 166/368 |
| 6,494,267 | B2 * | 12/2002 | Allen | 166/347 |
| 6,520,263 | B2 * | 2/2003 | June | 166/368 |
| 6,640,902 | B2 * | 11/2003 | Baten et al. | 166/368 |
| 6,668,919 | B2 * | 12/2003 | Radi | 166/208 |
| 6,672,396 | B1 * | 1/2004 | Marroquin et al. | 166/348 |
| 6,705,401 | B2 * | 3/2004 | Buckle et al. | 166/337 |
| 6,708,766 | B2 * | 3/2004 | Clark | 166/368 |
| 6,871,708 | B2 * | 3/2005 | Calder et al. | 166/348 |
| 7,025,145 | B2 * | 4/2006 | Emmerson | 166/348 |
| 7,028,777 | B2 * | 4/2006 | Wade et al. | 166/343 |
| 7,040,407 | B2 * | 5/2006 | Jennings et al. | 166/348 |
| 7,063,160 | B2 * | 6/2006 | Fenton et al. | 166/369 |
| 7,219,741 | B2 * | 5/2007 | Fenton et al. | 166/368 |
| 7,240,735 | B2 * | 7/2007 | Crozier | 166/344 |
| 7,314,086 | B2 * | 1/2008 | Hopper et al. | 166/348 |
| 7,445,046 | B2 * | 11/2008 | Borak, Jr. | 166/313 |
| 7,770,650 | B2 * | 8/2010 | Young et al. | 166/344 |
| 7,798,231 | B2 * | 9/2010 | Ford | 166/337 |
| RE43,262 | E * | 3/2012 | June | 166/368 |
| 8,220,550 | B2 * | 7/2012 | Dunn et al. | 166/351 |
| 8,322,443 | B2 * | 12/2012 | Given et al. | 166/368 |
| 8,371,385 | B2 * | 2/2013 | Lewis | 166/368 |
| 8,469,102 | B2 * | 6/2013 | Yates | 166/338 |
| 8,573,294 | B2 * | 11/2013 | Struthers et al. | 166/88.4 |
| 8,590,624 | B2 * | 11/2013 | Neto et al. | 166/344 |
| 8,678,093 | B2 * | 3/2014 | Willoughby | 166/338 |
| 2002/0117305 | A1 * | 8/2002 | Calder et al. | 166/358 |
| 2006/0260799 | A1 * | 11/2006 | Broussard | 166/75.14 |
| 2012/0193104 | A1 * | 8/2012 | Hoffman et al. | 166/348 |
| 2013/0213661 | A1 * | 8/2013 | Reimert | 166/348 |

* cited by examiner

SUBSEA WELLHEAD STABILIZATION USING CYLINDRICAL SOCKETS

BACKGROUND

1. Field of Invention

The present disclosure relates in general to a wellhead assembly for use in producing subterranean hydrocarbons. More specifically, the present disclosure relates to a wellhead assembly having high and lower pressure wellhead housings with sockets whose respective outer surfaces are generally cylindrical.

2. Description of Prior Art

Subsea wells typically include outer low pressure housing welded onto a conductor pipe, where the conductor pipe is installed to a first depth in the well, usually by driving or jetting the conductor pipe. A drill bit inserts through the installed conductor pipe for drilling the well deeper to a second depth so that high pressure housing can land within the low pressure housing. The high pressure housing usually has a length of pipe welded onto its lower end that extends into the wellbore past a lower end of the conductor pipe. The well is then drilled to its ultimate depth and completed, where completion includes landing a casing string in the high pressure housing that lines the wellbore, cementing between the casing string and wellbore wall, and landing production tubing within the casing. The aforementioned concentrically stacked tubulars exert a load onto the lower pressure housing that is transferred along an interface between the high and low pressure housings. Moreover, tilting the stacked tubulars generates a bending moment along the interface.

SUMMARY OF THE INVENTION

Disclosed herein a wellhead assembly, which in one embodiment includes an annular low pressure housing having a lower end set in a sea floor. In this example, an upper socket surface is formed along a portion of an inner surface of the low pressure housing; axially spaced apart from the upper socket surface is a lower socket surface formed along a portion of the inner surface of the low pressure housing. The wellhead assembly further includes an annular high pressure housing coaxially disposed within the low pressure housing, an upper socket surface formed along a portion of an outer surface of the high pressure housing that is in contact with the upper socket surface on the low pressure housing and that selectively exerts a load against the upper socket surface on the low pressure housing to define an upper loading interface. A lower socket surface is on the outer surface of the high pressure housing that is axially spaced apart from the upper socket surface on the high pressure housing and is in contact with the lower socket surface on the low pressure housing. The lower socket surface on the high pressure housing selectively exerts a load against the lower socket surface on the low pressure housing to define a lower loading interface. A latch assembly is coupled to the low pressure housing and the high pressure housing between the upper and lower loading interfaces. In an alternate example, the upper and lower loading interfaces project axially in a direction that is substantially parallel with an axis of the wellhead assembly. Optionally, the upper and lower loading interfaces are radially offset from one another. The wellhead assembly can alternatively further include a channel formed on an outer surface of the high pressure housing between the upper and lower loading interfaces and a passage axially formed through the high pressure housing having an end in communication with the channel and a lower end in communication with an annulus between the high and lower pressure housings on a side of the lower loading interface opposite the channel. Included with this example is a passage radially extending through the lower pressure housing and in communication with the channel. In an example embodiment the latch is made up of a C-ring set in a groove provided on an outer surface of the high pressure housing. The latch may include a profile on an inner surface of the low pressure housing. A downward facing shoulder can optionally be included on an outer surface of the high pressure housing that contacts an upward facing shoulder on an inner surface of the low pressure housing when the high pressure housing lands in the low pressure housing.

Also described herein is a wellhead assembly that includes a low pressure housing mounted in a sea floor having a high pressure housing landed within. The high pressure housing has upper and lower radially thinner portions and a radially thicker portion disposed between and adjacent to the upper and lower radially thinner portions. An upper loading surface is provided on an outer surface of the radially thicker portion that terminates at a location where the radially thicker portion transitions into the upper radially thinner portion. A lower loading surface is formed on the outer surface of the radially thicker portion that terminates at a location where the radially thicker portion transitions into the lower radially thinner portion. Upper and lower loading surfaces are included on an inner surface of the low pressure housing that respectively engage the upper and lower loading surfaces on the radially thicker portion. A latch is provided for engaging the low and high pressure housings disposed axially between the upper loading surface and lower loading surface on the high pressure housing. An optional channel can be included on an outer surface of the high pressure housing disposed between the upper loading surface and lower loading surface on the high pressure housing and a passage providing communication between the channel and an annulus between the low and high pressure housings and adjacent the location where the radially thicker portion transitions to the lower radially thinner portion. In an alternate example included is a production tree on an upper end of the high pressure housing. Optionally included is a casing hanger landed inside the high pressure housing and a tubing hanger landed inside the casing hanger.

BRIEF DESCRIPTION OF DRAWINGS

Some of the features and benefits of the present invention having been stated, others will become apparent as the description proceeds when taken in conjunction with the accompanying drawings, in which.

Figure 1:
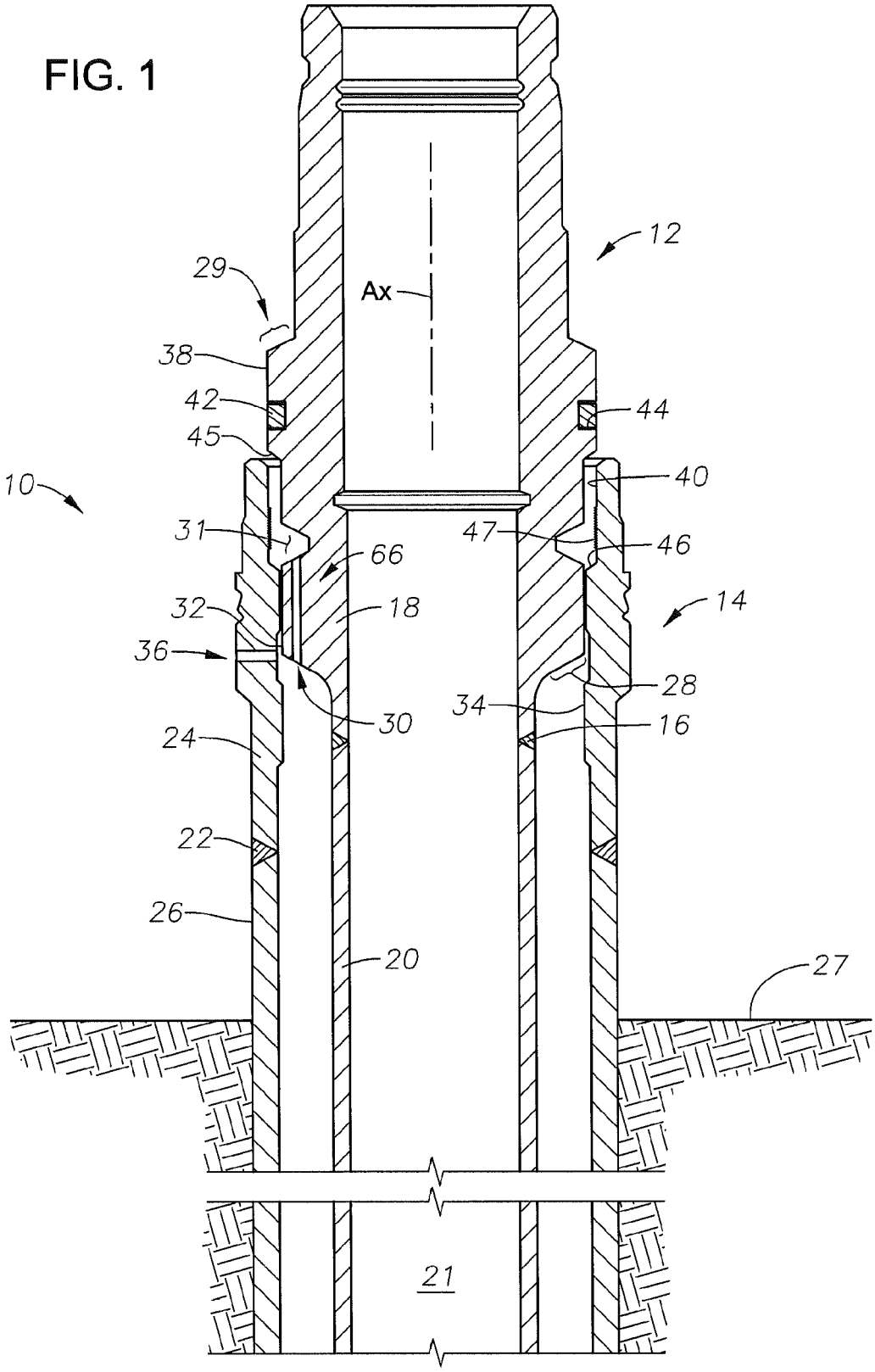
FIG. 1 is a side sectional view of engaging together example embodiments of high and low pressure wellhead housings in accordance with the present invention.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

FIG. 1 is a side sectional view of an example of a wellhead assembly 10 being formed by inserting a high pressure housing 12 into a low pressure housing 14. A weld 16 on the high pressure housing 12 of FIG. 1 attaches an upper portion 18 to a lower portion 20, where the lower portion 20 extends downward and into a wellbore 21. Similarly, the low pressure housing 14 includes a weld 22 attaching an upper portion 24 to lower portion 26. In the example of FIG. 1, the lower portion 26 is anchored within a sea floor 27. A transition 28 on the upper portion 18 indicates where its thickness changes. Below the transition 28 the thickness of the upper portion 18 is substantially the same as a thickness of the lower portion 20, whereas above the transition its thickness increases to a maximum width to define a middle section of the high pressure housing 12. An upper terminal end of the middle section is defined by an upper transition 29, which indicates a location where the radial thickness of the high pressure housing 12 decreases. The radial thickness of the high pressure housing 12 above the transition 29 is less than along the middle section, but greater than below transition 28. The changes in radial thickness define a thicker middle section with two radially thinner portions projecting axially away from the middle section. Further illustrated in the example of FIG. 1 is a passage 30 in the upper portion 18 that extends axially downward from a channel 31 shown circumscribing the middle portion along its outer surface. The passage 30 communicates between the channel 31 and an annulus between the high and low pressure housings 12, 14.

A lower socket surface 32 is shown formed on an outer periphery of the upper portion 18 and facing generally radially outward from an axis $A_X$ of the wellhead assembly 10; a lower end of the lower socket surface 32 terminates adjacent the transition 28. The low pressure housing 14 also includes a lower socket surface 34 that is formed on an inner circumferential surface of the low pressure housing 14. In the example of FIG. 1, a lower end of the lower socket surface 34 terminates adjacent where the radial thickness of the low pressure housing 14 decreases to a thickness substantially the same as a thickness of the lower portion 26. In one embodiment, a radial passage 36 is further illustrated that extends through the upper and thicker portion 24 of the low pressure housing 14. In an example embodiment, the radial passage 36 is above an upper terminal end of the lower socket surface 34.

Still referring to FIG. 1, upper socket surface 38 is similarly provided on the outer surface of the high pressure housing 12 shown facing generally radially outward from the axis $A_X$, and having an upper end that terminates adjacent transition 29. An upper socket surface 40 on the low pressure housing 14 faces radially inward towards axis $A_X$ and has an upper terminal end proximate an upper terminal end of the low pressure housing 14. As further discussed below, a latching system is included for coupling together the high and low pressure housings 12, 14 that includes s C-ring 42 disposed within a groove 44 formed on the outer surface of the radially thicker section of the upper portion 18. The C-ring 42 and groove 44 illustrate one example of embodiment of a latching mechanism for engaging the high and low pressure housings 12, 14.

Figure 2:
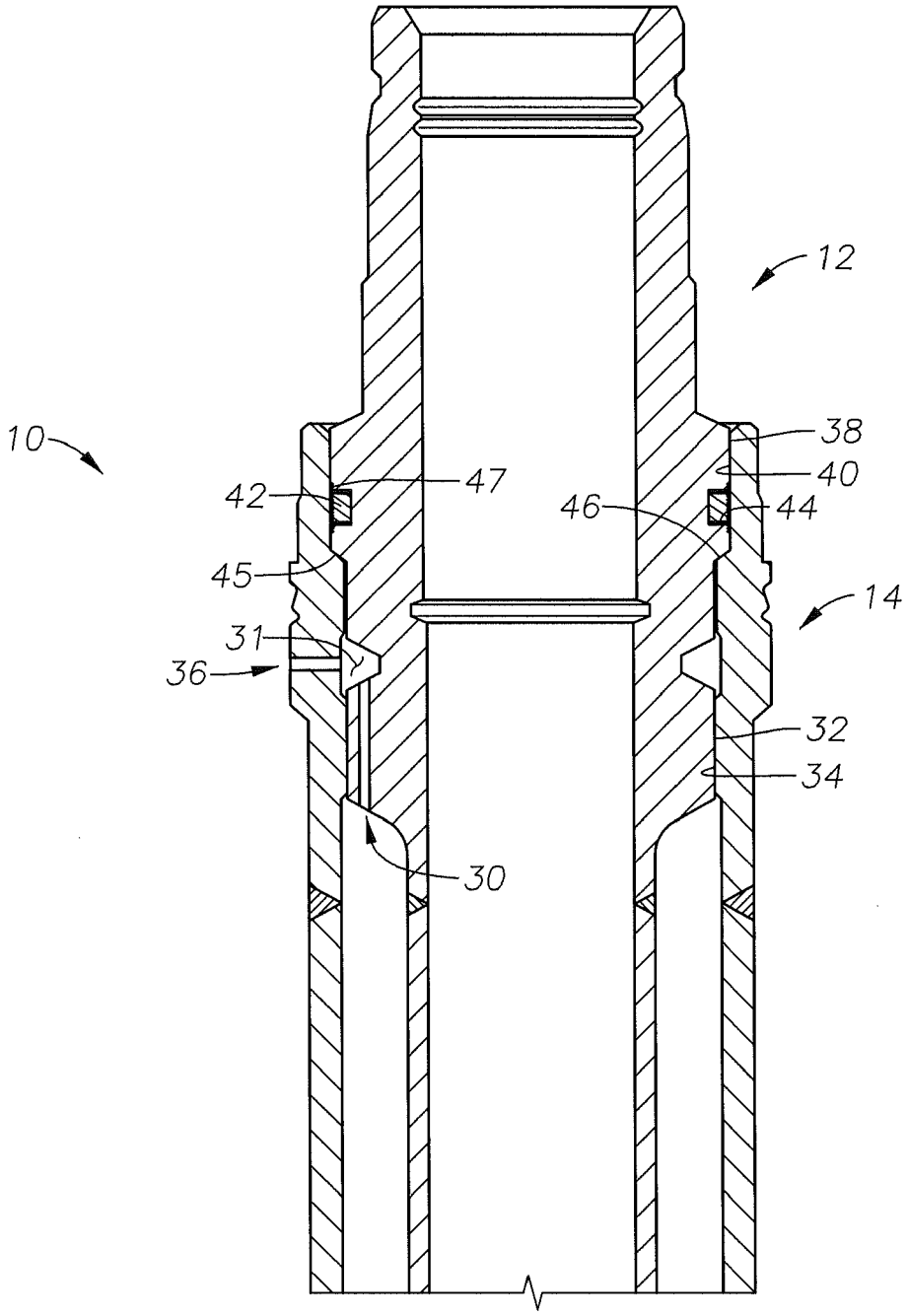
FIG. 2 is a side perspective view of the high and low pressure wellhead housings of FIG. 1 in engagement to form a portion of an embodiment of a wellhead assembly and in accordance with the present invention.

Referring now to FIG. 2, an example is illustrated of the high pressure housing 12 landed within low pressure housing 14. In this example, the upper socket surfaces 38, 40 are aligned and in contact with one another so that any bending moment forces exerted onto the high pressure housing 12 can be transferred onto the low pressure housing 14. Axially distal from the upper socket surfaces 38, 40 are the lower socket surfaces 32, 34, also in engagement and in contact with one another for effectively transferring bending moment loads from the high pressure housing 12 to low pressure housing 14. In the embodiment illustrated, the lower socket surfaces 32, 34 are a maximal distance from the upper socket surfaces 38, 40, thereby increasing bending moment transfer between the inner and outer wellhead housings 12, 14 and consequently reducing respective angular movement of the high pressure housing 12 within low pressure housing 14. When in the landed configuration of FIG. 2, the passage 36 registers with channel 31, so that passage 36 is in fluid communication with passage 30 and with the annulus between the high and low pressure housings 12, 14 As shown, passage 36 and channel 31 are between the lower socket surfaces 32, 34 and the upper socket surfaces 38, 40. Further shown in the example of FIG. 2 are load shoulders 45, 46 respectively formed on the high and low pressure housings 12, 14, which are in axial contact with one another, thereby transferring an axial load from the high pressure housing 12 onto the low pressure housing 14 for supporting the high pressure housing 12 within low pressure housing 14. Additionally, a profile 47 is shown formed on an inner surface of the low pressure housing 14 and strategically located so to engage an outer surface of the C-ring 42 for latching together the high and low pressure housings 12, 14. Moreover, by locating the latching mechanism of the C-ring 42, along with the channel 31, axially between the upper socket surfaces 38, 40 and lower socket surfaces 32, 34, the maximal distance between the socket surfaces can be achieved. As such, forgings of the upper portions 18, 24 need not be altered in order to achieve sufficient bending moment transfer between the housings 12, 14.

Another advantage of the wellhead housing 10 disclosed herein is that in one embodiment, the socket surfaces 32, 34, 38, 40 each are generally vertical so that minimal forces are required to insert the high pressure housing 12 within low pressure housing 14. In one example of use, axial forces required to urge the high pressure housing 12 inside low pressure housing 14 were less than about 200,000 pounds force.

Figure 3:
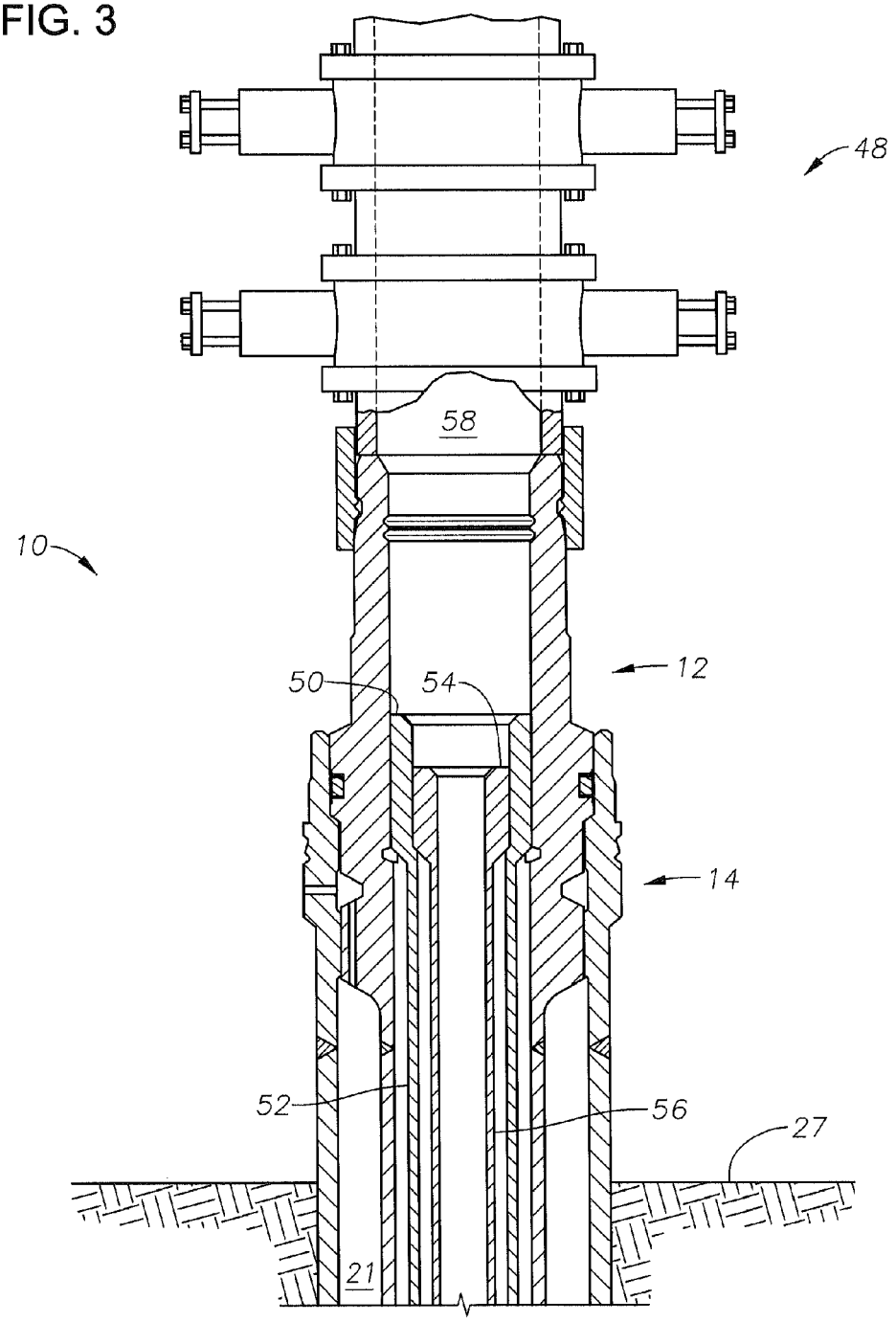
FIG. 3 is a side sectional view of the portion of the wellhead assembly of FIG. 2 further including a production tree and in accordance with the present invention.

FIG. 3 is a side sectional view of an example of the wellhead assembly 10 shown with a production tree 48 mounted on an upper end of the high pressure housing 12. Further illustrated is a casing hanger 50 landed on an inner surface of the high pressure housing 12 and supporting a string of casing 52 shown depending downward into the wellbore 21. Coaxially inserted within the casing 52 is a tubing hanger 54 having a corresponding string of tubing 56 that projects coaxially within the casing 52. Thus, in this example, the low pressure housing 14 axially supports the load of the high pressure housing 12 tubing and casing hangers 50, 54, casing 52, and tubing 56. Further in the example of FIG. 3, the tubing communicates with a main bore 58 that projects axially through the production tree 48.

In one optional example, one of the socket surfaces can have a convex shape while an opposing or mating socket surface can still have a cylindrical or substantially vertical profile. Similarly, both the inner and outer socket surfaces may have convex shapes that deform when the high pressure housing 12 inserts and lands within the low pressure housing 14. In another optional embodiment, one of the socket team members can be in a separate housing where the housing is welded to the member holding the other socket surface.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

What is claimed is:

1. A wellhead assembly comprising:

a low pressure housing that is annular and has a lower end for setting in a sea floor;

a low pressure housing upper socket surface formed along a portion of an inner surface of the low pressure housing and a low pressure housing lower socket surface formed along a portion of the inner surface of the low pressure housing that is axially spaced apart from the to pressure housing upper socket surface;

a low pressure housing load shoulder formed in the inner surface of the low pressure housing at a point axially between the low pressure upper socket surface and the low pressure lower socket surface;

a latch profile formed in the inner surface of the low pressure housing at a point axially between the load shoulder and the low pressure socket surface;

an annular high pressure housing having a single-piece body that is annular and coaxially disposed within the low pressure housing;

a high pressure housing upper socket surface integrally formed with the body of the high pressure housing along a portion of an outer surface of the high pressure housing that is in contact with the low pressure housing upper socket surface;

a high pressure housing lower socket surface integrally formed with the body of the high pressure housing on the outer surface of the high pressure housing axially spaced apart from the high pressure housing upper socket surface and in contact with the low pressure housing lower socket surface;

a high pressure housing load shoulder on the high pressure housing landed on the low pressure housing load shoulder in the inner surface of the low pressure housing;

a latch carried by the high pressure housing that engages the latch profile in the inner surface of the low pressure housing; and wherein the high pressure housing and low pressure housing upper socket surface are cylindrical and the high pressure housing and low pressure housing lower socket surfaces are cylindrical.

2. The wellhead assembly of claim 1, further comprising:

a port extending through a side wall of the low pressure housing from an outer side to an inner side, the port being axially located between the low pressure housing upper and lower socket surfaces in the inner surface of the low pressure housing;

an annular channel formed on the outer surface of the high pressure housing between the high pressure housing upper and lower socket surfaces of the high pressure housing, the annular channel being located radially inward from the port; and a passage axially formed through the high pressure housing having an upper end at the channel and a lower end in communication with an annulus between the high and low pressure housings below the high pressure housing and low pressure housing lower socket surfaces.

3. The wellhead assembly of claim 2, wherein the passage is located radially inward and separated from the high pressure housing lower socket surface on the high pressure housing.

4. The wellhead assembly of claim 1, wherein the latch comprises a C-ring set in a groove provided on an outer surface of the high pressure housing.

5. A wellhead assembly comprising:

a vertical axis;

a low pressure housing for mounting in a sea floor;

a high pressure housing landed in the low pressure housing and having single-piece body with upper and lower radially thinner portions and a radially thicker portion disposed between and adjacent to the upper and lower radially thinner portions;

a high pressure housing upper loading surface integrally formed with the body of the high pressure housing on an outer surface of the radially thicker portion that terminates at a location where the radially thicker portion transitions into the upper radially thinner portion;

a low pressure housing upper loading surface on an inner surface of the low pressure housing and in loading contact with the high pressure housing upper loading surface to define an upper loading interface;

high pressure housing lower loading surface integrally formed with the body of the high pressure housing on the outer surface of the radially thicker portion that terminates at a location where the radially thicker portion transitions into the lower radially thinner portion;

a low pressure housing lower loading surface on the inner surface of the low pressure housing that is in loading contact with the high pressure housing lower loading surface to define a lower loading interace;

a port extending through a side wall of t he low pressure housing between the upper and tower loading interfaces;

an annular, concentric channel formed on the radially thicker portion of the high pressure housing between the upper and lower loading interfaces and in registry with the port;

the lower radially thinner portion of the high pressure housing being spaced radially inward from a lower portion of the low pressure housing, defining, a casing annulus;

a passage formed in the radially thicker portion, the passage having a lower end at a lower end of the radially thicker portion in fluid communication with the casing annulus and an upper end at the channel in fluid communication with the port, the passage being radially inward and separated from the lower loading interface; and wherein the high pressure housing upper loading surface and lower loading surface are cylindrical, and the low pressure housing upper loading surface and lower loading surface are cylindrical.

6. The wellhead assembly of claim 5, further comprising:

a low pressure housing load shoulder in the inner surface of the low pressure housing at a point axially between the upper and lower loading interfaces; and a high pressure housing load shoulder on the high pressure housing that lands on the low pressure housing load shoulder in the inner surface of the low pressure housing.

7. The wellhead assembly of claim 6, further comprising a latch on the high pressure housing at a point axially between the upper loading interface and the high pressure housing load shoulder.

8. The wellhead assembly of claim 5, further comprising a casing hanger landed inside the high pressure housing and a tubing hanger landed inside the casing hanger.

9. A wellhead assembly having a longitudinal axis and comprising:

a low pressure housing having a bore;

an upper bore socket formed in the bore at an upper end of the bore;

a latch profile in the bore below the upper bore socket;

a conical low pressure housing load shoulder formed in the bore below the latch profile;

a lower bore socket formed in the bore below the low pressure housing load shoulder;

a port extending through a side wall of the low pressure housing at a point axially between the low pressure housing load shoulder and the bore lower bore socket;

a high pressure housing having a single-piece body landed in the bore of the low pressure housing;

an upper external socket integrally formed with the body of the high pressure housing that engages the upper bore socket;

a lower external socket integrally formed with the body of the high pressure housing that engages the lower bore socket;

a latch carried by the high pressure housing below the upper external socket that snaps into engagement with the latch profile in the low pressure housing;

a conical external high pressure housing load shoulder on the high pressure housing below the latch that lands on the low pressure housing load shoulder in the bore;

the high pressure housing having a lower end portion extending downward from the lower external socket, defining a casing annulus between the lower end portion and the low pressure housing;

a concentric annular channel formed in an outer surface of the high pressure housing axially between the external high pressure housing load shoulder and the lower external socket, radially inward from and in fluid communication with the port; and an axially extending passage having an upper end at the annular channel in fluid communication with the port and a lower end below the lower external socket in fluid communication with the easing annulus, the axially extending passage being located radially inward from the lower external socket; and wherein the upper external socket and the upper bore socket are cylindrical, and the lower external socket and the lower bore socket are cylindrical.

10. The wellhead assembly according to claim 9, wherein:

the channel has a lower edge located below the port that is an upward facing surface; and the upper end of the passage terminates at the lower edge of the channel.

* * * * *